US005570742A

United States Patent [19]

Reynolds et al.

[11] Patent Number: 5,570,742

[45] Date of Patent: Nov. 5, 1996

[54] TUBULAR CLEANING TOOL

[75] Inventors: J. Scott Reynolds, Aberdeen, Scotland; Robert L. Sloan, Katy; Darrell P. Salisbury, Sugar Land, both of Tex.

[73] Assignee: Well-Flow Technologies, Inc., Houston, Tex.

[21] Appl. No.: 450,391

[22] Filed: May 25, 1995

Related U.S. Application Data

[63] Continuation-in-part of Ser. No. 78,542, Jun. 16, 1993, Pat. No. 5,419,397.

[51] Int. Cl.[6] ..... E21B 37/02; E21B 37/06

[52] U.S. Cl. ..... 166/173; 15/104.16; 15/104.2; 166/176; 166/312

[58] Field of Search ..... 166/173, 176, 166/170, 174, 171, 177.3, 311, 312; 15/104.16, 104.2

[56] References Cited

U.S. PATENT DOCUMENTS

| | | | |
|---|---|---|---|
| 1,342,618 | 6/1920 | Bashara . | |
| 1,392,105 | 9/1921 | Bergesen, Sr. . | |
| 1,598,771 | 9/1926 | Gerhardt . | |
| 1,713,895 | 5/1929 | Ford . | |
| 1,855,046 | 4/1932 | Gerhart . | |
| 2,190,145 | 2/1940 | Braden | 166/174 |
| 2,334,788 | 11/1943 | O'Leary | 166/173 X |
| 2,392,144 | 1/1946 | Hall | 15/104.06 |
| 2,447,966 | 8/1948 | Stephens | 15/104.06 |
| 2,509,922 | 5/1950 | Hall . | |
| 2,567,475 | 9/1951 | Hall . | |
| 2,695,673 | 11/1954 | Coyle | 166/170 |
| 2,715,552 | 7/1955 | Lane . | |
| 3,176,772 | 4/1965 | MacGregor | 166/173 |
| 3,541,628 | 6/1968 | Girard | 15/104.06 |
| 3,827,492 | 8/1974 | Hammon et al. | 166/173 |
| 4,164,980 | 8/1979 | Duke | 166/291 |
| 4,345,350 | 8/1982 | Burd | 15/104.06 R |
| 4,427,065 | 1/1984 | Watson | 166/250 |
| 4,438,812 | 3/1984 | Hammon | 166/173 |
| 4,501,322 | 2/1985 | Martin | 166/173 |
| 4,548,271 | 10/1985 | Keller | 166/291 |
| 4,612,986 | 9/1986 | Fosdick, Jr. et al. | 166/312 X |
| 4,720,884 | 1/1988 | Ralls | 15/104.061 |
| 4,747,452 | 5/1988 | Clark | 166/311 |
| 4,809,779 | 3/1989 | Ledyashov et al. | 166/173 |
| 4,896,720 | 1/1990 | DeRouen | 166/170 |

FOREIGN PATENT DOCUMENTS

| | | |
|---|---|---|
| 243104 | 7/1993 | Argentina . |
| 225145 | 6/1987 | European Pat. Off. . |
| 727621 | 4/1955 | United Kingdom . |

OTHER PUBLICATIONS

Bowen, Sales literature entitled "Bowen Tubing Casing Scrapers" (1986–87 Composite Catalog of Old Field Equipment and Services, p. 555, vol. 1, 37th Revision; World Oil).

OM, Sales literature entitled "OM Casing Scraper" (1986–87 Composite Catalog of Oil Field Equipment and Services, p. 5158, vol. 4, 37th Revision; World Oil).

HOMCO, Sales literature entitled "Casing Patches" (1986–87 Composite Catalog of Oil Field Equipment and Services, p. 2691, vol. 2, 87th Revision; World Oil.

Grant Oil Tool Company, Sales literature entitled "Casing Scraper Models 5500,5600" (1986–87 Composite Catalog of Oil Field Equipment and Services p. 2346, vol. 2, 87th Revision; World Oil.

A–Z, Sales Literature entitled "Hole Opener Casing Scraper" (1986–87 Composite Catalog of Oil Field Equipment and Services, p. 157, vol. 1, 87th Revision; World Oil).

BCW, Sales literature entitled "BCW Casing Scraper" (1986–87 Composite Catalog of Oil Field Equipment and Services, p. 290, vol. 1, 87th Revision; World Oil).

*Primary Examiner*—Stephen J. Novosad

[57] ABSTRACT

A cleaning tool for tubular members has a pattern of scratching elements arranged on the outside of an elongate member such as a mandrel. The mandrel is coated with a rigid or resilient polymeric material or a combination of both. The scratching elements are affixed in the polymeric material in an arrangement to allow fluid flow around the mandrel.

41 Claims, 7 Drawing Sheets

TUBULAR CLEANING TOOL

RELATED APPLICATION

This application is a continuation-in-part of Ser. No. 08/078,542 filed Jun. 16, 1993 entitled "Well Cleaning Tool with Scratching Elements", now U.S. Pat. No. 5,419,397, by J. Scott Reynolds and Robert L. Sloan and is incorporated by reference herein in its entirety.

FIELD OF THE INVENTION

This invention pertains to cleaning tools for tubular members including those employed in oil, gas, or water well cleaning, drilling, production, completion and workover operations. This invention also applies to other industries requiring cleaning of tubular members such as plumbing parts and cannon barrels. The tools have a plurality of scratching elements or bristles for independently removing debris from the interior surface of tubular members and can be used in combination with fluids such as solvents and cleaning solutions for such purposes. Also, the invention can be used for removing filtercake or near wellbore material in open hole sections. The invention can also be used as a polishing brush for casing for setting down hold tools or cementing.

BACKGROUND OF THE INVENTION

Tubular members, particularly metallic tubular members, used in various industrial applications may be difficult to clean. In cases where debris adheres to the inside wall of the tubular member, it takes significant scrubbing action to remove the debris and often chemical cleaners alone are inadequate. Metal scraping blades can mar the interior surface of the tubular member. Also, the blades may break off and cause retrieval problems.

One of the industries with tubular cleaning projects is the well drilling industry. Oil, gas, water and other types of wells almost always use casing, a steel pipe, to ensure the integrity of a well borehole. The casing wall is cemented during the completion stage of a drilling operation. This cementing operation leaves cement residue on the casing wall which must be removed before initiating well production. Cleaning of the casing wall is also necessary at intervals during well production when debris and residue, such as oil, paraffin and scale, accumulate on the casing wall.

The standard tools used for cleaning casing walls are referred to as casing scrapers and are well known in the art. A typical casing scraper is incorporated in a "plug" and usually incorporates metal blades attached to an elongated body. The blades scrape the casing wall as a hydraulic or mechanical force displaces the body through the casing. A disadvantage of plug-scrapers propelled by hydraulic force is that the scrapers and the debris scoured from the casing wall are not retrievable. The scrapers and debris are displaced to a point past the formation of interest where they remain to clutter the well borehole.

Alternatively in the prior art, a scraper is mounted onto a tool that is attached to the workstring for mechanical manipulation and retrieval once the cleaning operation has been completed. However, a drawback of such scraper tools is that the blades often shear off during cleaning, and a high cost fishing job is required to remove the lost component from the well. Another disadvantage exists in the fact that many common casing scrapers do not achieve 360 degree contact with the casing wall unless they are rotated during the cleaning process. This rotation increases the probability of blades being sheared off the body.

An example of a casing scraper that ameliorates many of these deficiencies of the current technology is disclosed in U.S. Pat. No. 4,896,720. This form of a plug-scraper employs bristles rather than blades, and the entire tool is constructed of easily drillable materials. Therefore, the need for expensive fishing jobs is eliminated. However, neither the tool nor the debris scoured from the casing wall is retrievable under the disclosure in U.S. Pat. No. 4,896,720. Other bushing tools utilizing bristles have been developed. Examples of such tools are disclosed in U.S. Pat. Nos. 1,342,618, 1,855,046, 3,827,492, 4,438,812, 4,501,322, and 4,747,452. Most of these brushing tools are not used in the well cleaning industry because the brushes are not sufficiently stiff nor do they contact the casing wall with sufficient pressure to achieve the same extent of scouring as the scrapers.

SUMMARY OF THE INVENTION

The invention is for a cleaning tool for scouring debris from the interior wall of a tubular member. It is not intended to limit the tool's use. Any type or size of tubular member that requires cleaning of the interior wall will benefit from the cleaning tool.

The cleaning tool is made from an elongated member with a curved outer surface. Preferably the elongate member is a cylinder with a circular outer surface. At least part of the surface of the side wall is covered by a layer of polymeric material. The polymeric material can be either organic, inorganic or mixture of both. In the polymeric layer on the outer surface of the side wall scratching elements are affixed in a pattern. The pattern of scratching elements provide that upon introduction into the tubular member that its inner surface is contacted with the scratching elements upon moving the elongate member along the inside wall of the tubular member and in some cases where the pattern is so arranged rotating the elongate member. The pattern of scratching elements also provide for channels of fluid flow between the pattern arrangement of scratching elements to allow fluid flow around the elongate member when introduced inside the tubular member to be cleaned. The outer diameter of the elongate member can be variably sized so that the scratching elements contact the inside wall of the tubular member upon introduction of the elongate member into the tubular member. The pattern of scratching elements can be a regular geometric pattern, an irregular pattern or a mixture of geometric and irregular figures. The pattern is created by dense areas of scratching elements or in the preferred embodiment, bristles.

The cleaning tool can be attached to a drill string or other mechanism to impart rotational movement. In one embodiment the cleaning tool is slipped over a mandrel and fastened by a locking collar on one end and a top sub on the other to the mandrel. The mandrel may be attached to a drill string which rotates.

The polymeric side wall layer material can be rigid or a resilient material or a combination of both. It is preferable that scratching elements are affixed in a layer of resilient material in the pattern selected. The term scratching element is used to encompass a broad range of materials that can be used in the invention described such as metallic or plastic bristles, tungsten or tungsten-carbide chips, diamonds, sand, pea gravel or softer scratching elements that can be used for scouring chrome pipe. The scratching elements can be used on carbon steel, chrome or other alloys. In one preferred embodiment the scratching elements are metallic bristles. The metallic bristles can be held on fabric backing which bristles and fabric backing are affixed in the polymeric material. In an alternate embodiment a resilient polymeric layer is provided under the scratching elements and the rest of the elongate member is covered by a rigid polymeric material.

The elongate member can be a solid cylinder or tubular with a central open bore. An alternate embodiment is a tube with one closed end and fluid outlets communicating from the interior of the elongate member through the side wall.

Another embodiment of this invention is a kit using the cleaning tool of the present invention with a solvent. The cleaning tools can have a bore through which the solvent or the diluted solvent can circulate through the bore and out the end of the cleaning tool to the outside of the tool and flow up through the channels between the bristles. The tools with one closed end have fluid outlets in the side walls to permit the solvent to flow to the outside of the tool. Also, the tool with a solid elongate body may be used with the solvent by circulating the solvent while rotating or reciprocating the tool.

DESCRIPTION OF THE INVENTION

The following description discusses the figures which are not necessarily to scale and are in some instances schematic depictions. This description of the invention will illustrate the various advantages, features and characteristics of the cleaning tool to those skilled in the art.

Figure 1:
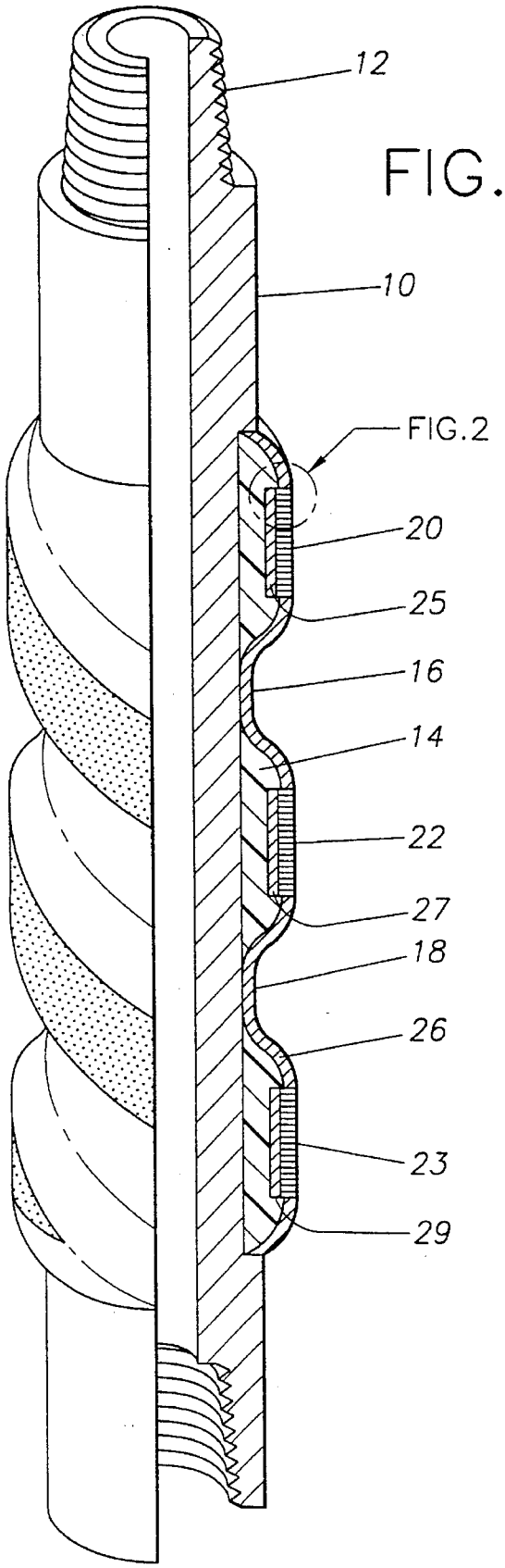
FIG. 1 is a quarter section of an embodiment of the cleaning tool.

FIG. 1 is a quarter section through the cleaning tool. The elongate member is typically a metal mandrel 10 shown with a threaded tapered end 12. The resilient polymeric layer 14 is formed on the mandrel 10 with channels 16 and 18 created for fluid flow around the tool. Preferably the mandrel is metal, however, other durable materials could be used. The scratching elements are preferably patterned dense groupings of bristles shown in the cross-section at 20, 22 and 23 are affixed to the polymeric layer. In the preferred embodiment shown in FIG. 1, the resilient layer 14 forms the raised pattern on mandrel 10 and does not cover the entire outside wall of the mandrel 10 For tools larger in diameter than 10 ¾ inches the preferred embodiment has a resilient polymer layer with channels formed in the resilient polymer. The preferred resilient polymer is polyurethane. The bristles are densely arranged to create the pattern with areas between the dense bristles for fluid flow. The resilient polymeric layer 14 may be coated with an additional polymeric layer 26 after the bristles are affixed. The polymeric layer 26 also coats the mandrel 10. The preferred polymeric layer 26 is a rigid polyurethane or polyurea. The scratching elements shown as bristles can be tungsten or tungsten-carbide chips, diamonds, sand or pea gravel embedded in the polymeric layer 14.

Figure 2:
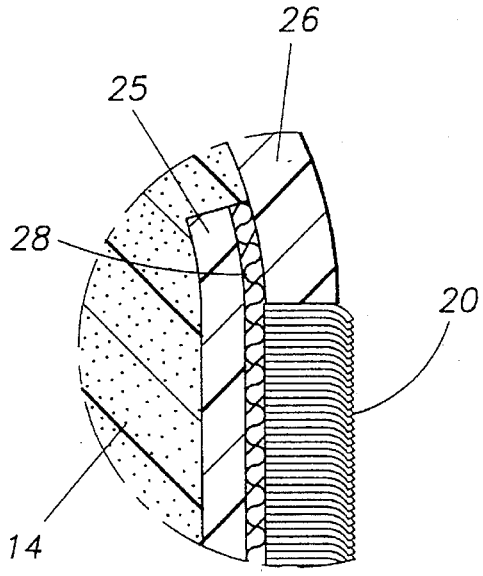
FIG. 2 is a detailed cross-section of the circled area on FIG. 1.

The preferred bristles are similar to u-shaped staples inserted into a fabric backing. The bristles can have slanted tips. FIG. 2 is a blow up of the area FIG. 2 shown on FIG. 1. The dense arrangement of slanted bristles 27 is shown on the fabric backing 28 (not shown on FIG. 1). The polymeric layer 14 and coating layer are shown in the enlarged detail in FIG. 2. FIG. 2 also shows bonding resin layer 25 which is used is a preferred embodiment for affixing the fabric backed bristles. The bonding resin layers are also shown at reference numerals 27 and 29. In some cases the fabric backing extends through the polymer layers to the mandrel surface. The bonding resin is used to affix the fabric to the mandrel.

When a rigid polymeric material such as rigid polyurethane is used the bristles will deform to some degree when the cleaning tool is introduced into the member to be cleaned. When a resilient polymer is used, the polymer layer exhibits compressibility. In both cases the bristles contact the inner surface of the tubular member during the scouring process to remove debris. The outer diameter of the cleaning tool is sized according to the tubular member to be cleaned.

The cleaning tool shown in FIG. 1 can be used in many applications. A pup joint is provided for attachment. The mandrel 10 has a central bore through which cleaning fluids may be pumped. Typically the cleaning fluids recirculate out the opposite end of mandrel 10 and pass on the outside of the tool through channels provided as shown at reference numerals 16 and 18. The tool as shown in FIG. 1 can be used to clean pipe on racks, cannon barrels and other tubular members in a horizontal position.

Figure 3:
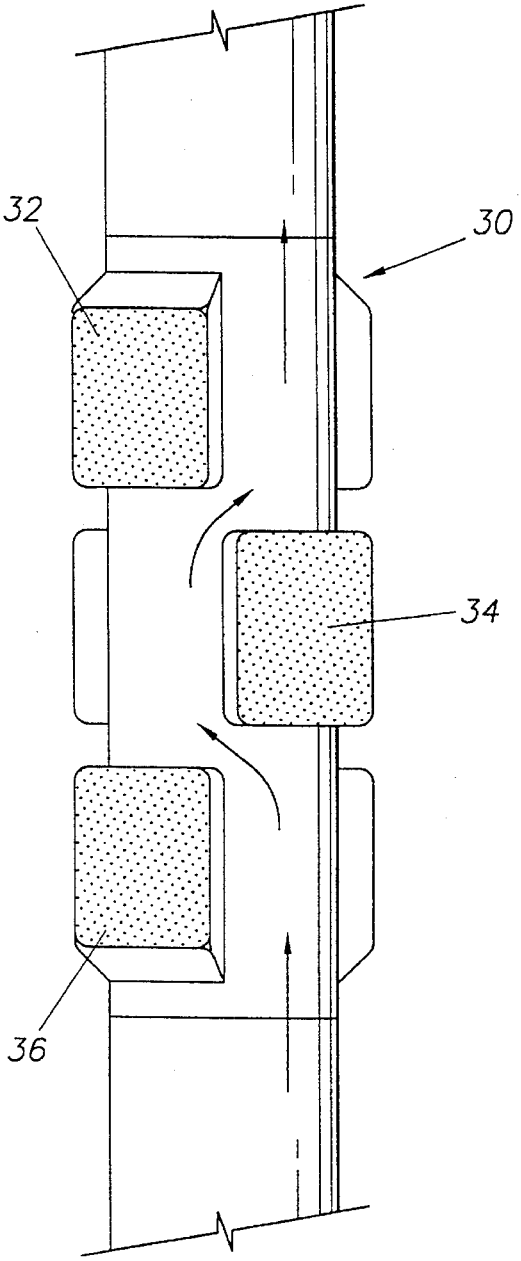
FIG. 3 is a schematic view of a pattern of bristles in rectangular configuration.

FIG. 3 shows an arrangement of scratching elements in generally rectangular configuration on cleaning tool 30. The entire cleaning tool is not shown. The scratching elements are rectangular patches of bristle arranged on the outside side wall so that bristles contact the inside of the tubular member during the cleaning process without need to rotate tool 30. In the preferred embodiment the bristles are in a dense arrangement in the patches. If desired, the tools of this invention can be rotated during the scouring process. The bristle patches 32, 34 and 36 shown have areas in between each other for fluid channeling. The arrows illustrate one path for fluid flow around the bristle patches. FIG. 3 is an example of one of the patterns of with fluid channels. Other patterns of scratching elements can be used.

Figure 4:
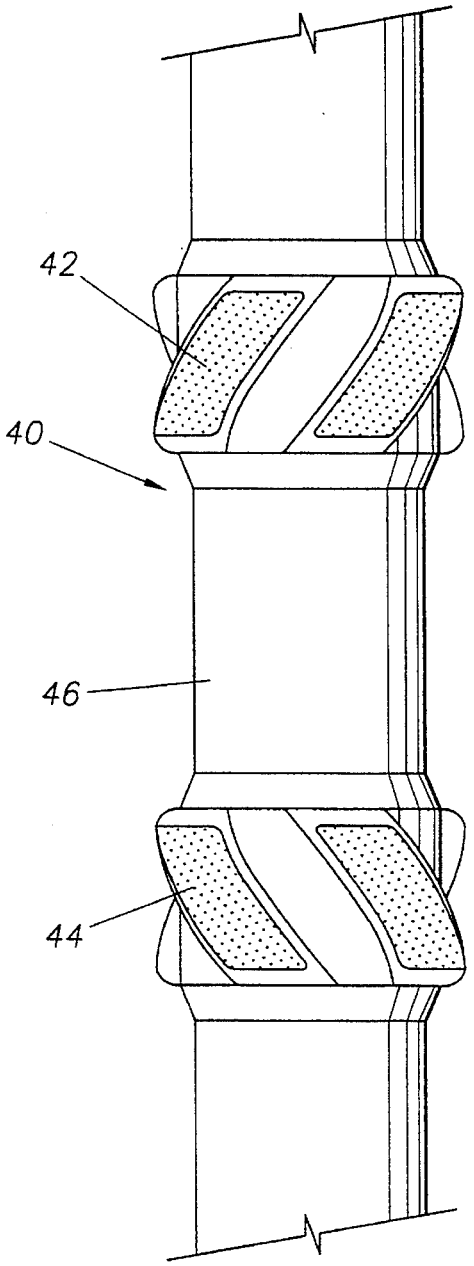
FIG. 4 is a schematic view of a pattern of bristles of 2 sets of swathes in a truncated helical arrangement.

FIG. 4 is another embodiment of the cleaning tool 40 with a different arrangement of bristle scratching elements to further illustrate the variety of bristle patterns that can be used. In FIG. 4 the cleaning tool 40 has two sets of truncated helical swathes of bristles generally indicated at 42 and 44. The truncated helical swathes of bristles are spaced apart on cleaning tool 40 with the polymer layer in between covering side wall 46. In this embodiment the side wall 46 may be left uncoated and remain bare metal or other suitable durable material.

Figure 5:
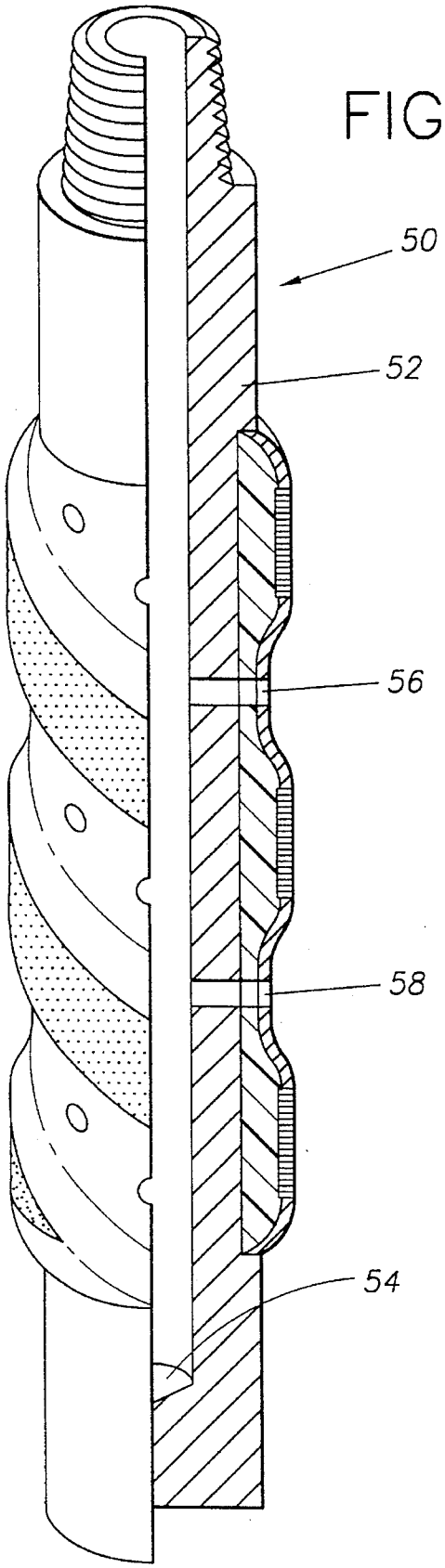
FIG. 5 is a quarter section of the alterative embodiment with a closed bottom and fluid outlets.

In FIG. 5 the cleaning tool 50 is a mandrel 52 with closed end 54. The bristles are shown in a helical swath with channels between the helix. Fluid outlets illustrated in the section part of the drawing at 56 and 58 communicate from the inner bore of mandrel 52 through the side wall. Other fluid outlets are shown in the perspective view of FIG. 5. Fluid can be introduced into the bore of mandrel 52 and will flow freely through the fluid outlets.

Figure 6:
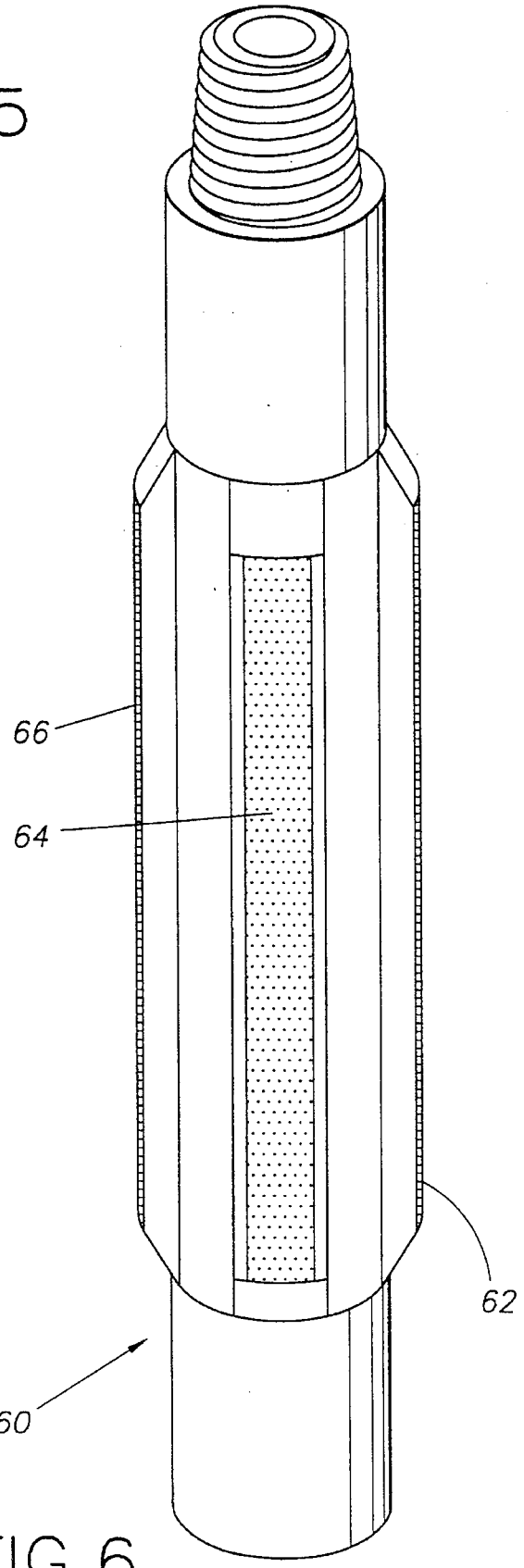
FIG. 6 is an embodiment of the cleaning tool with longitudinal swathes of scratching elements.

FIG. 6 is an alternative embodiment of a cleaning tool 60. The scratching elements are arranged in a pattern such that tool 60 is rotated if the interior surface tubular member to be cleaned must be contacted by the scratching elements. Otherwise, only the interior areas of the tubular member that correspond with the scratching elements shown at 62, 64 and 66 will be contacted. In FIG. 6 the scratching elements are shown as a series of longitudinally arranged bristles in a dense pattern. FIG. 6 is for illustrative purposes to show a scratching element arrangement for a cleaning tool that involves rotational movement for cleaning substantially the entire interior surface of a tubular member.

Figure 7:
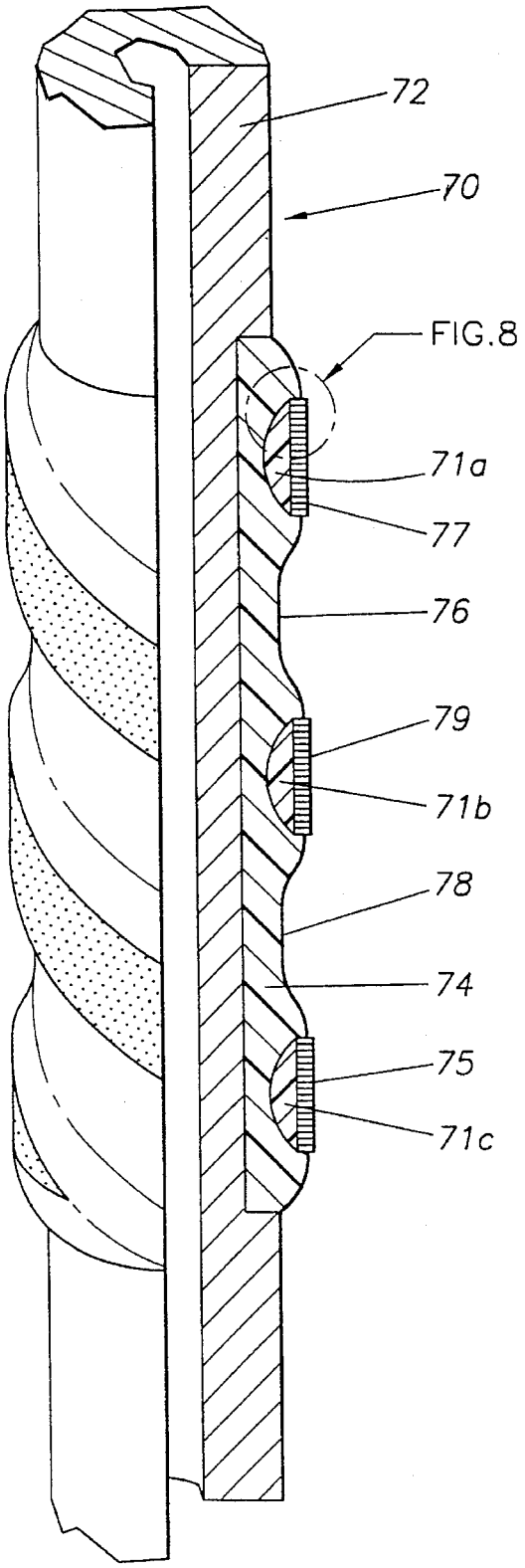
FIG. 7 is a quarter section showing the use of a resilient polymeric layer under the bristle scratching elements.
Figure 8:
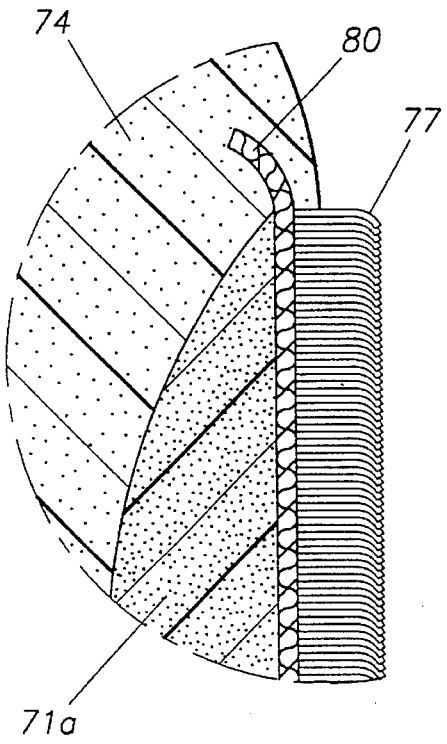
FIG. 8 is a detail cross section of the area of FIG. 7 of the bristles, fabric backing and resilient polymeric layer.

FIG. 7 is a quarter-section of an embodiment using two types of polymeric materials for tool 70. The metal mandrel 72 has a layer of rigid polymer 74 formed on the mandrel with channels illustrated at 76 and 78. FIG. 8 is an enlarged view of the area designated on FIG. 7. FIG. 8 is an enlargement of the scratching elements shown in a helical swath on FIG. 7. The cross-section of the scratching elements are shown as dense arrangements of bristles at numerals 75, 77 and 79. Under the bristles 77 as shown in detail FIG. 8 is an additional layer of resilient polymer 71*a* into which is affixed bristles 77. The fabric backing 80 is also shown in FIG. 8. This embodiment provides a compressible layer under the bristles which also may deform during the cleaning process. The resilient layer is shown as 71*a*, 71*b*, and 71*c*.

Figure 9:
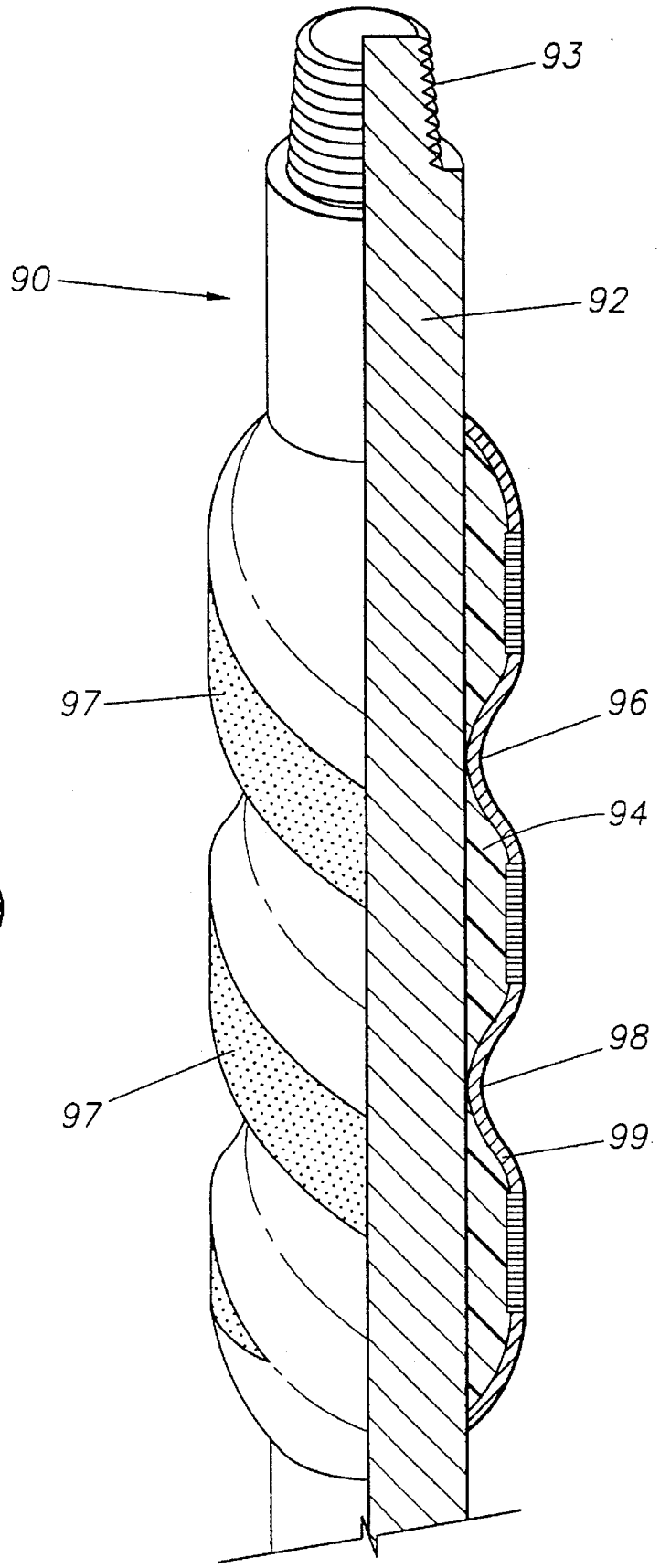
FIG. 9 is a quarter section of a solid elongate member.

FIG. 9 is an embodiment of the cleaning tool 90 with a solid elongate member 92. Cleaning tool 90 is shown with a resilient polymer layer 94 formed on elongate member 92 with channels 96 and 98 for fluid flow as previously described. The rigid polymer layer 99 covers the resilient layer 94 and contacts the elongate member 92 in the channel areas 96 and 98. The scratching elements are shown as a helical swatch of bristles 97 as previously described. The cleaning tool 90 is adapted for use on a wire line on any other application where fluid flow through the tool is not needed or desirable. Threaded connection 93 is shown.

Figure 10:
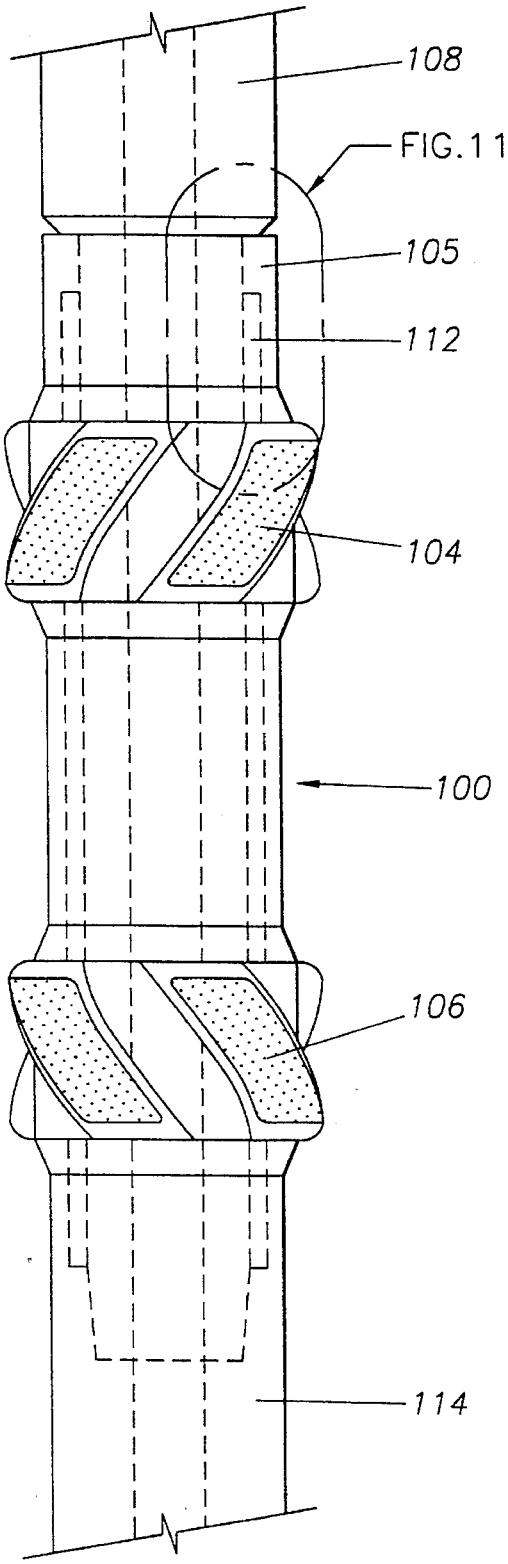
FIG. 10 is a view of the cleaning tool showing adaptable to connection to a drill string.
Figure 11:
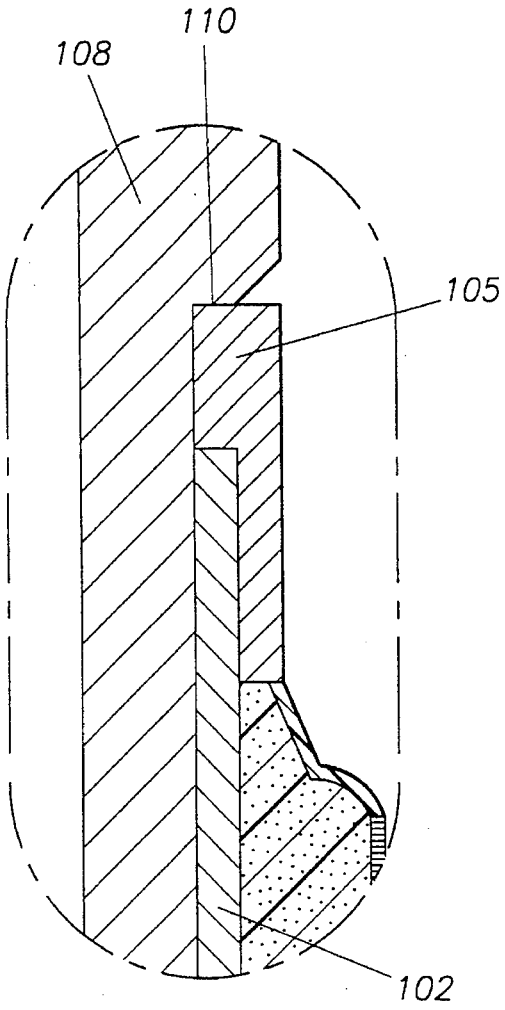
FIG. 11 is a detail of the locking collar from FIG. 10.

FIG. 10 is an embodiment of cleaning tool 100 with schematic representation of use of the tool of the present invention as a mandrel adapted for attachment on a drill string. The tool includes a mandrel 102. For purposes of illustration, the scratching elements are shown as two series of truncated helixes 104 and 106. FIG. 11 is a detail cross section from FIG. 10 to illustrate the parts. Mandrel 102 is placed over sleeve 108 which can connect with the workstring through a threaded connection which is not shown. A locking collar 105 is placed on sleeve 108. The locking collar abuts the recess of sleeve 108 at 110. The locking collar secures the mandrel with the engagement of male castlettes on the sleeve and female castlettes as shown at reference numeral 112 on the collar. The sleeve 108 is connected to a top sub 114 through a threaded connection. The top sub has an additional threaded connection (not shown) for connection to a work string if desired. Thus connected the tool is secured to and will rotate by action inputted by the workstring.

FIGS. 12*a*, 12*b*, 12*c* and 12*d* are a variation on a preferred embodiment with open cells formed under the scratching elements that communicate by at least one outlet outside the tool. Preferably a plurality of open cells with outlets are formed under the scratching elements. The figures are enlargements of the area shown in FIG. 8 except four different shaped cells of voids are illustrated as open spaces in each of FIGS. 12*a–d*. In each FIG. 120*a*, 120*b*, 120*c* and 120*d* reference the rigid polymeric material. In each figure the resilient polymeric material is referenced as 122*a*, 122*b*, 122*c* and 122*d*. The scratching elements shown as bristles 124*a*, 124*b*, 124*c* and 124*d* and fabric backing 126*a*, 126*b*, 126*c* and 126*d*.

Figure 12A:
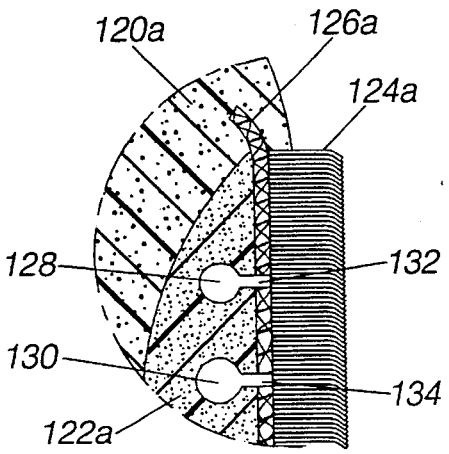
FIGS. 12*a*, 12*b*, 12*c* and 12*d* are details showing an alternative embodiment with open cells under the bristles.
Figure 12B:
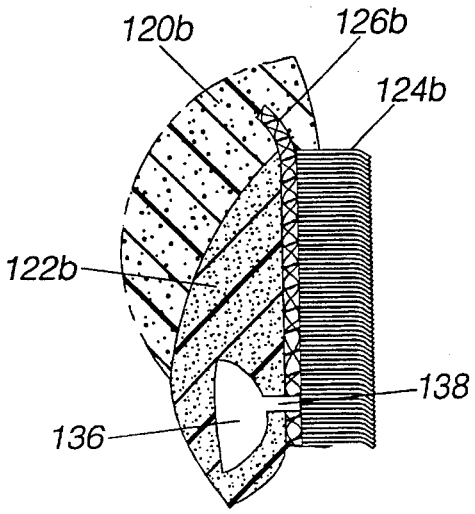
Figure 12C:
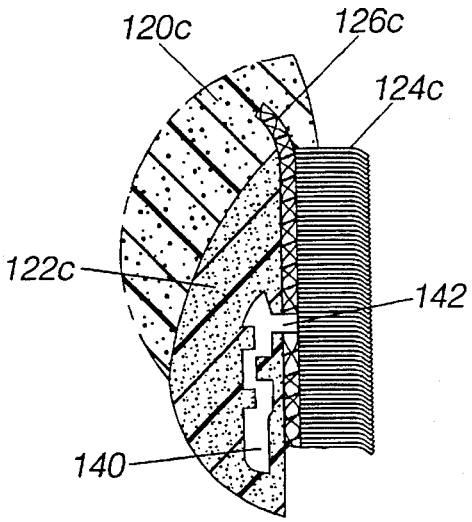
Figure 12D:
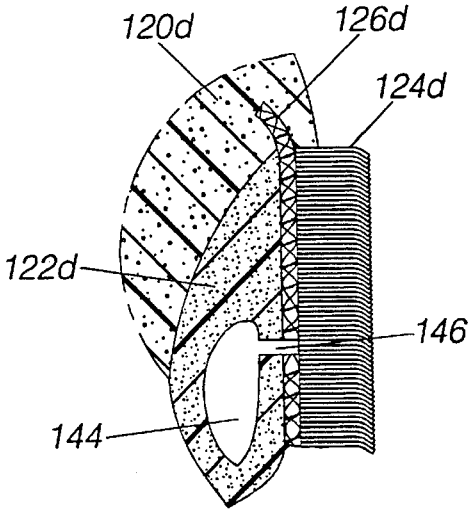

The resilient layer in each of the FIGS. 12*a–d* have open cells of different shapes with an outlet from the cell communicating outside the tool. As shown in FIG. 12*a* two generally spherical cells 128 and 130 are shown with outlets 132 and 134. In FIG. 12*b* a half-spherical cell 136 is formed in resilient layer 122*b* with outlet 138. In FIG. 12*c* irregular cell 140 is shown with outlet 142. FIG. 12*d* illustrates an elongated bladder cell 144 and outlet 146. A shape of open cell can be used. More than one outlet can be used to communicate from the inside of the cell to outside the tool. The cells are used for pressure equalization and additional resiliency. Fluid from outside the tool can flow into the open cells. A number of open cells can be formed under the scratching elements.

This invention also includes a kit of the cleaning tool and a solvent capable of adding in the removal of debris from the interior wall of a tubular member. The preferred solvent or cleaning fluid use is compatible with an exposed polymeric material, scratching elements or other material used to make the cleaning tool. Cleaning fluids and solvents are well known to those skilled in the art. A fluid or solvent that would cause any of the materials to swell or degrade are preferred. Examples of preferred cleaning fluids and solvents are blends of nonaromatic hydrocarbons, blends of surfactants and solvents, and blends of surfactants.

The embodiments described herein are illustrative of the invention and are not intended to limit the claimed invention in any way. Other embodiments will be apparent to those skilled in the art.

What is claimed is:

1. A cleaning tool for scouring debris from the interior wall of a tubular member, comprising an elongate member with a curved outer surface;

said elongate member having outside walls with part of the surface covered with a layer of polymeric material;

scratching elements affixed in the polymeric material in said side wall in a pattern whereupon introduction into the tubular member to be cleaned the inner surface of said tubular member is contacted with the scratching elements upon moving the elongate member along the inside wall of the tubular member and upon rotating the elongated member;

the pattern of scratching elements arranged to allow fluid flow around the elongated member when introduced inside the tubular member; and said elongated member having an outer diameter such that the scratching elements contact the inside wall of the tubular member upon introduction of the elongate member into the tubular member to be cleaned.

2. A cleaning tool of claim 1 wherein said elongate member is adaptable to connect to a rotational imparting means.

3. A cleaning tool of claim 1 wherein said pattern of scratching elements is a series of densely arranged scratching elements in longitudinal swathes with channels in between each swath.

4. A cleaning tool of claim 1 wherein said scratching elements are selected from the group consisting of metallic bristles, tungsten chips, tungsten-carbide chips, diamond chips, gravel, sand and mixtures thereof.

5. A cleaning tool of claim 1 wherein the elongate member has a circular outer surface.

6. A cleaning tool of claim 1 wherein the outer side wall is covered by a layer of polymeric material.

7. A cleaning tool of claim 1 additionally comprising a resilient polymeric layer under the scratching elements.

8. A cleaning tool of claim 1 wherein said elongate member is cylindrical capable of fluid flow through the inside bore of the elongate member.

9. A cleaning tool of claim 1 wherein said elongate member in a cylindrical tube with one closed end and has fluid outlets in the side wall.

10. A cleaning tool of claim 1 wherein said elongate member is solid cylinder.

11. A cleaning tool of claim 1 wherein the polymeric material is selected from the group consisting essentially of polyurethane and polyurea.

12. A cleaning tool of claim 1 additionally comprising at least one open cell formed in the polymeric material under the scratching elements with at least one outlet communicating from each open cell to the outside of the cleaning tool.

13. A cleaning tool for scouring debris from the interior wall of a tubular member, comprising an elongate member with a curved outer surface;

said elongate member having an outside side wall with part of the surface covered with a layer of polymeric material;

scratching elements affixed in the polymeric material in said side wall in a pattern such that upon introduction into the tubular member to be cleaned the inner surface of said tubular member is contacted with the scratching elements upon moving the elongate member along the inside wall of the tubular member;

the pattern of scratching elements arranged to allow fluid flow around the elongate member when introduced inside the tubular member; and said elongate member having an outer diameter such that the scratching elements contact the inside wall of the tubular member upon introduction of the elongate member into the tubular member.

14. A cleaning tool of claim 13 wherein said elongate member is adaptable to connect to a rotational imparting means.

15. A cleaning tool of claim 13 wherein said pattern of scratching elements is a series of swathes spaced apart on the elongate member.

16. A cleaning tool of claim 13 wherein said pattern of scratching elements is a series of truncated helical swathes.

17. A cleaning tool of claim 13 wherein said scratching elements are arranged in a pattern of dense areas of scratching elements on the side wall with channels between the dense areas of scratching elements.

18. A cleaning tool of claim 13 wherein said elongate member has a circular outer surface.

19. A cleaning tool of claim 13 wherein the outer side wall is covered by a layer polymeric material.

20. A cleaning tool of claim 13 additionally comprising a resilient polymeric layer under the scratching elements.

21. A cleaning tool of claim 13 wherein the polymeric material is selected from the group of polyurethane and polyurea.

22. A cleaning tool of claim 13 wherein said elongate member is cylindrical capable of fluid flow through an inside bore of said elongate member.

23. A cleaning tool of claim 13 wherein said elongate member is a cylindrical tube with one closed end and has fluid outlets in the side wall.

24. A cleaning tool of claim 13 wherein said elongate member is a solid cylinder.

25. A cleaning tool of claim 1 wherein said elongated member is a cylinder additionally comprising a mandrel extending through the cylinder adapted to connect to a workstring;

a locking collar affixed to the first end of the cylinder and of the mandrel so that the cylinder does not rotate with respect to the mandrel; and a top sub affixed to the second end of the mandrel and to the second end of the cylinder to ensure that the cylinder does not translate with respect to the sleeve.

26. A cleaning tool of claim 13 wherein said elongated member is a cylinder additionally comprising a mandrel extending through the cylinder adapted to connect to a workstring;

a locking collar affixed to the first end of the cylinder and of the mandrel so that the cylinder does not rotate with respect to the mandrel; and a top sub affixed to the second end of the mandrel and to the second end of the cylinder to ensure that the cylinder does not translate with respect to the sleeve.

27. A cleaning tool of claim 13 wherein the scratching elements are selected from the group consisting of metallic bristles tungsten chips, tungsten-carbide clips, diamond chips, gravel, sand and mixtures thereof.

28. A cleaning tool of claim 13 wherein said scratching elements are on a fabric backing which backing are securely embedded in a polymeric layer on the side wall.

29. A cleaning tool of claim 13 additionally comprising at least one open cell formed in the polymeric material under the scratching elements with at least one outlet communicating from each open cell to the outside of the cleaning tool.

30. A cleaning tool for scouring debris from the interior wall of a tubular member, comprising a mandrel;

said mandrel having outside side walls covered with a layer of rigid polymeric material;

a second layer of resilient polymeric material covering said rigid polymeric material;

bristles affixed in the resilient polymeric material arranged in a pattern of dense areas of bristles with channels for fluid flow between the pattern of bristles; and said mandrel having an outer diameter such that the bristles contact the inside wall of the tubular member for scouring debris.

31. A cleaning tool of claim 30 wherein the resilient polymeric material is a layer generally between the bristles and the rigid polymeric material.

32. A cleaning tool of claim 30 wherein the bristles are on a fabric backing which backing and bristles are securely embedded in the resilient polymeric material.

33. A cleaning tool of claim 30 additionally comprising at least one open cell formed in the resilient polymeric material under the bristles with at least one outlet communicating from each open cell to the outside of the cleaning tool.

34. A cleaning tool for scouring debris from the interior of a tubular member, comprising a mandrel;

said mandrel having resilient polymeric layer in a raised pattern on the mandrel with channels in between;

scratching elements arranged in a pattern and affixed on the resilient polymeric layer with a bonding resin layer whereupon introduction into the tubular member to be cleaned the inner surface of said tubular member is contacted with the scratching elements upon moving the elongate member along the inside wall of the tubular member;

a coating of a non-resilient polymeric layer covering the mandrel in the channels created between the resilient polymeric layer and coating the resilient polymeric layer not covered by the scratching elements; and the elongate member having an outer diameter such that the scratching elements contact the inside wall of the tubular member upon introduction of the elongate member into the tubular member to be cleaned.

35. A cleaning tool of claim 34 wherein said scratching elements contact the inner surface of the tubular member to be cleaned upon rotation of the elongate member.

36. A cleaning tool of claim 34 wherein said scratching elements are in a pattern of densely arranged scratching elements with channels in between the areas of densely arranged scratching elements.

37. A cleaning tool of claim 34 additionally comprising at least one open cell formed in the resilient polymeric layer and bonding resin layer under the scratching elements with at least one outlet communicating from each open cell to the outside of the cleaning tool.

38. A kit for cleaning debris from the interior wall of a tubular member comprising a cleaning tool of claim 1; and a fluid capable of aiding in the removal of debris from the interior wall of a tubular member.

39. A kit for cleaning debris from the interior wall of a tubular member comprising a cleaning tool of claim 13; and a fluid capable of aiding in the removal of debris from the interior wall of a tubular member.

40. A kit for cleaning debris from the interior wall of a tubular member comprising a cleaning tool of claim 30; and a fluid capable of aiding in the removal of debris from the interior wall of a tubular member.

41. A kit for cleaning debris from the interior wall of a tubular member comprising a cleaning tool of claim 34; and a fluid capable of aiding in the removal of debris from the interior wall of a tubular member.

* * * * *